United States Patent [19]

Ohkubo

[11] 3,971,505

[45] July 27, 1976

[54] CONTAINER

[76] Inventor: Hachiro Ohkubo, 3-23, Higashi, Nozato-cho, Nishiyodogawa, Osaka, Japan

[22] Filed: Nov. 8, 1974

[21] Appl. No.: 522,207

Related U.S. Application Data

[63] Continuation-in-part of Ser. No. 328,228, Jan. 31, 1973, abandoned.

[52] U.S. Cl. ..... 229/45 R; 229/44 CB; 229/36

[51] Int. Cl.[2] ..... B65D 5/66; B65D 45/00; B65D 5/22

[58] Field of Search ..... 229/45, 36, 43, 44 R, 229/44 CB

[56] References Cited

UNITED STATES PATENTS

| | | | |
|---|---|---|---|
| 1,130,271 | 3/1915 | Hammond | 229/45 |
| 2,527,167 | 10/1950 | Wauda | 229/36 |
| 2,579,346 | 12/1951 | Theander | 229/45 |

*Primary Examiner*—William Price
*Assistant Examiner*—Douglas B. Farrow
*Attorney, Agent, or Firm*—Allison C. Collard

[57] ABSTRACT

A container having a hanging wall at the front of a lid pivotally connected at its rear to the body of the container, an upwardly folded stopping member provided on the inner surface of the hanging wall, a stopping device provided by elastically folding the top of the front wall of the body in an outward direction, the stopping member and device being so constructed that the latter engages the former to prevent further movement when the lid is closed, and a finger pressing piece provided in the front hanging wall in such a way as to stand face to face with the stopping device, the pressing piece being defined by cut lines and a frangible linking or bridging portion between them which serves as a sealing device.

1 Claim, 5 Drawing Figures

CONTAINER

This is a continuation-in-part application of Ser. No. 328,228 filed Jan. 31, 1973, now abandoned.

This invention relates to a container which is simple in construction, and a lid of which is sealed by a linking or bridging portion between cut lines until the lid is opened for the first time. After the first opening, the lid can be closed very tightly. In opening the lid for the first time, one presses down the finger pressing piece until the linking portion is cut off, and the seal is thus released to allow the lid to be opened quite easily.

Conventional containers which have hitherto been used have the defect in that their lids can be opened accidentally when they are placed upside down or accidentally dropped. Thus, the contents may spill. If the contents are harmful substances to eat, such as drugs or cosmetics, there is the danger that an infant may catch and put them into the mouth, causing great harm.

The invention removes such defects, and the inventive container has several advantages.

One of the major objects of this invention is to provide a sealing effect in a container by making its lid incapable of being opened, namely by the presence of a linking or bridging portion, before the lid is opened for the first time.

Another object is to provide a container which is simple in construction, whose lid can maintain a tightly closed state, and will not open even when it is upside down or is dropped, even after the lid has been opened for the first time.

Yet another object of the invention relates to the provision of a container which is very difficult to be opened by a child and which is, on the other hand, quite easy to be opened by an adult.

A further object of the invention is to provide a container which has a construction suitable for mechanical mass production.

A yet further object is directed to the provision of a container with a simple yet smart appearance.

Other objects and many of the attendant advantages of the invention will be readily appreciated as the same becomes better understood by reference to the following detailed description. Although simple in construction, the container of this invention features a pair of cut lines, and a frangible linking or bridging portion between them, which serves as a sealing device until its lid is closed for the first time. In opening the lid for the first time, the linking portion is cut off, and the lid is opened quite easily. In general, a simple conventional container, without the inventive features, is apt to open quite easily and even accidentally. This is not the case with the inventive container.

A container cannot perform its function properly if its lid is opened quite frequently. On the other hand, if its lid is closed so tightly that it can be opened only with difficulty, it will be inconvenient to use such a container. Or if the container is very complicated in its construction, it will be very expensive and unsuitable for mechanical mass production.

The container of this invention has none of these defects. It is simple in construction and is suitable for mechanical mass production, and can be produced at low cost. What is more, until it is opened for the first time, it is sealed. When it is closed after the first opening, the lid will not open even when the container is dropped, maintaining a tightly closed condition. Besides, when an infant tries to open its lid, he or she cannot do so, because it is beyond a child's comprehension to push a finger pressing piece, to be described later in more detail, consciously with the tip of his or her finger, to open the lid. But an adult with some judgment can push the finger piece quite easily with his finger to open the lid. Thus, it may be said that the utility value of the container is very high.

The following detailed description should be considered in conjunction with the accompanying drawings, wherein FIG. 1 is a perspective view of a container according to the invention, shown with its lid closed;

Figure 1:
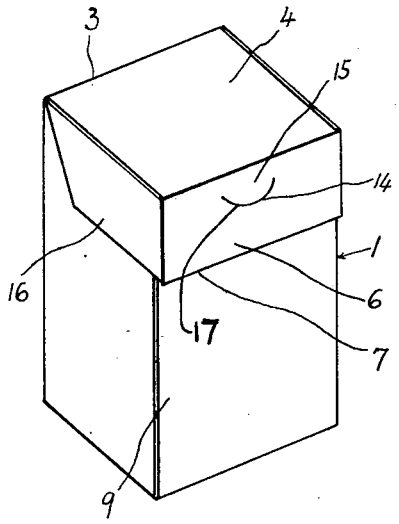
Figure 2:
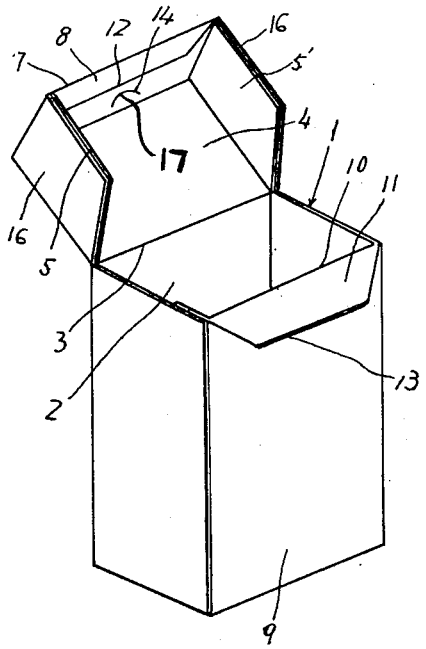
FIG. 2 is a similar view of the container with the lid open.

An exemplary embodiment of the inventive container is now described in detail, with reference to the illustrations. A body 1 of the hexahedral container is shown in FIG. 2 with its top or lid 4 open. The lid is integrally connected at a fold line 3 to the top of a back wall 2 of the body 1. Side hanging walls 5, 5' are respectively provided at the left- and right-hand sides of the lid 4; a front hanging wall 6 is provided at the front of the lid 4, above a front wall 9 of the body 1.

Figure 5:
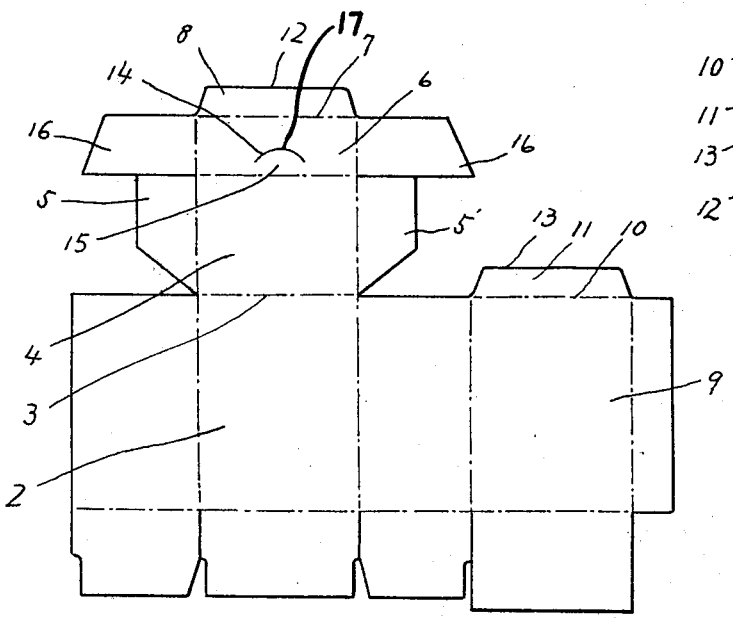
FIG. 5 is a development of the inventive container.

Pasting pieces 16 are integrally provided at both sides of the front hanging wall 6. By affixing the pieces 16 to the side walls 5, 5', the wall 6 and the side walls 5, 5' of the lid can be formed as a continuous body, as can be seen from the developed illustration of FIG. 5. The hanging wall 6 is folded back slightly at a fold line 7 at its lowest portion, and is pasted to the inner surface of the wall 6 to form a stopping member 8.

Figure 3:
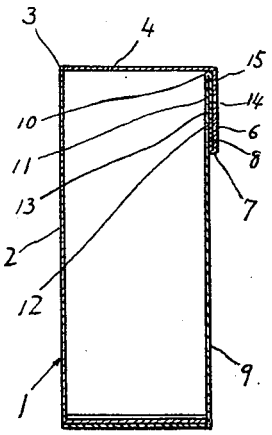
FIG. 3 is a longitudinal cross-sectional view of the container with its lid closed.

A stopping device 11 is integrally connected at a fold line 10 to the upper portion of the front body wall 9. The stopping device 11 is folded back upwardly with some elasticity at the line 10. As shown in FIG. 3, it is so constructed that an upper portion 12 of the stopping member 8 is engaged with a lower portion 13 of the stopping device 11 to allow no further movement when the lid 4 is closed. As shown, a downward looking semicircularly cut line 14 is, or two line portions are, provided at a slightly upper portion of the hanging lid wall 6. The area inside the cut line 14 constitutes a finger pressing piece 15, and there is a frangible bridging or linking portion 17 between them. Once the linking portion is cut off, the finger piece 15 will have a free end portion for the first time.

The stopping member 8 is pasted to the inner surface of the front hanging wall 6, while the stopping device 11 is not pasted to the front wall 9 but is nearly so folded back outwardly at the fold line 10 that it has some elasticity in the outward direction. Thus, the container of this invention can always maintain a tightly closed state.

As has been said before, the finger piece 15 is defined by the cut line(s) 14 and the linking portion 17. Until the latter is cut off, the stopping device 11 cannot be pushed down by the finger piece 15, and the engagement of the stopping member 8 with the stopping device 11 remains maintained so as to make it difficult for the lid 4 to be opened. Thus the linking portion 17 has a unique effect as a sealing device.

If however the finger piece 15 is pressed down a little harder by the user's fingertip, it is easily cut off, and if it is further pressed down, the stopping device 11 will retreat inwardly, in opposition to its own elasticity.

Thus, the stopping member 8 and the stopping device 11 are disengaged to open the lid 4 quite easily. What is more, the container of this invention is simple in construction, and is suitable for mechanical mass production at low cost. Thus, the effect of this invention is quite remarkable.

Before the lid 4 of the container is opened for the first time, there is an uncut portion between the line or lines 14. This uncut portion is the frangible linking or bridging portion 17 lying between the cut lines. Thus, the finger pressing piece 15 and the hanging lid wall 6 are continuous through the portion 17. In other words, the linking portion constitutes a bridge between the finger piece and the front hanging wall.

The cut line 14 constitutes means which breaks the continuation of the linking portion 17 and thereby disengages the upper and lower portions 12, 13 for opening the lid 4 when it is pressed in by the user's finger.

Figure 4:
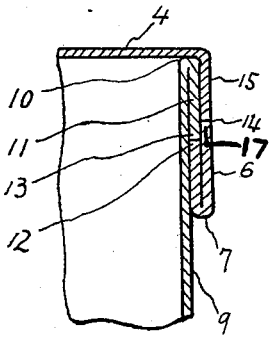
FIG. 4 is an enlarged partial view showing the essential parts of FIG. 3.

When the lid is closed, as may be been seen in FIG. 4, the piece 15 and the front hanging wall 6 are continuous by the linking portion 17. So long as they are continuous, it is impossible to disengage the portions 12, 13 by allowing the finger piece 15 to press the stopping device 11. Thus, the presence of the linking portion 17 indicates that the inventive container has never been opened.

Next, when there arises the necessity to take out the contents of the container, it is necessary and unavoidable to break the portion 17 by pushing the piece 15 so as to disengage the portions 12, 13. In other words, the discontinuance between the piece 15 and the front wall 6 at the portion 17 clearly indicates that the container has already been opened.

In case that the continuity of the linking portion 17 is maintained, it indicates that the lid 4 of the container has never been opened, that is, the sealing has not been tampered with since the contents were placed inside the container, and its lid subsequently closed.

On the other hand, in order to open the lid 4, it is necessary to disengage the portions 12, 13 by pressing the piece 15. But when the latter is pressed in, the linking portion 17 is inevitably broken. Once it is broken, the portion 17 cannot be restored to its previous continuous state.

Thus, when the portion 17 has been broken, we know that the container has already been opened. Thus, the presence or absence of the linking portion 17 indicates clearly whether the inventive container has ever been opened or not.

It should be understood, of course, that the foregoing disclosure relates only to a preferred embodiment of the inventive container, and that it is intended to cover all changes and modifications of the example described which do not constitute departures from the spirit and scope of the invention.

What I claim is:

1. A hexahedral container comprising a bottom wall and four tightly closed-up side walls, constituting a body of the container, one of said walls being a front wall; a lid capable of being freely opened and closed said lid, said lid being integrally but pivotally connected at its rear to the top of said body; a hanging wall at the front of said lid; a stopping member attached to the hanging wall indicated on the inner surface of said hanging wall; a stopping device at the top of said front wall, said stopping device being elastic in the outward direction; said stopping member and said stopping device having free end abutment portions engaging each other to prevent further movement when said lid is closed; and a finger pressing piece on said hanging wall, said pressing piece is defined by at least one cut line in said hanging wall and a frangible linking portion thereat linking said pressing piece to said hanging wall, between said cut line, said hanging wall and said pressing piece, respectively, covering said abutment portions of said stopping member and said stopping device when said lid is closed, said frangible linking portion comprising means for sealing said container and for preventing opening thereof unless said frangible linking portion is broken as well as for providing indicia that the container has never been opened.

* * * * *